US009177463B2

(12) United States Patent
Leyden et al.

(10) Patent No.: US 9,177,463 B2
(45) Date of Patent: Nov. 3, 2015

(54) ALARM SYSTEM WITH SMART SENSORS

(71) Applicant: Se-Kure Controls, Inc., Franklin Park, IL (US)

(72) Inventors: Roger J. Leyden, Inverness, IL (US); David M. Adams, Bensenville, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 106 days.

(21) Appl. No.: 14/029,151

(22) Filed: Sep. 17, 2013

(65) Prior Publication Data

US 2015/0077254 A1 Mar. 19, 2015

(51) Int. Cl.
*G08B 13/14* (2006.01)
*G08B 25/00* (2006.01)

(52) U.S. Cl.
CPC ..... *G08B 25/008* (2013.01); *G08B 13/1454* (2013.01)

(58) Field of Classification Search
CPC ..... H05K 7/20836; H05K 7/20736; G06F 19/3418; G06F 19/3406; G06F 17/30; G06F 8/00; G06K 19/07; G06K 19/07354; G06K 19/0717; G06K 19/07749; G06K 7/10009; G07C 2009/00095; G07C 9/00087; G07C 5/00
USPC ..... 340/572.1, 572.2–572.9, 568.1, 568.2, 340/568.4, 568.8, 6.1, 8.1, 3.1, 501, 506, 340/540
See application file for complete search history.

(56) References Cited

U.S. PATENT DOCUMENTS

| | | | | |
|---|---|---|---|---|
| 4,772,878 | A | 9/1988 | Kane | |
| 5,347,263 | A | 9/1994 | Carroll et al. | |
| 5,552,771 | A * | 9/1996 | Leyden et al. | 340/568.2 |
| 5,910,768 | A * | 6/1999 | Ott | 340/568.2 |
| 6,761,579 | B2 | 7/2004 | Fort et al. | |
| 7,053,774 | B2 * | 5/2006 | Sedon et al. | 340/568.2 |
| 7,202,417 | B2 | 4/2007 | Marszalek et al. | |
| 7,403,119 | B2 | 7/2008 | Leyden | |
| 7,446,659 | B2 | 11/2008 | Marsilio et al. | |
| 7,526,539 | B1 * | 4/2009 | Hsu | 709/223 |
| 8,102,262 | B2 * | 1/2012 | Irmscher et al. | 340/568.1 |
| 8,106,772 | B2 | 1/2012 | Irmscher et al. | |
| 2005/0206522 | A1 * | 9/2005 | Leyden et al. | 340/568.4 |
| 2012/0218109 | A1 * | 8/2012 | Tatsumi et al. | 340/568.8 |

* cited by examiner

*Primary Examiner* — Daniel Previl
(74) *Attorney, Agent, or Firm* — Wood, Phillips, Katz, Clark & Mortimer

(57) ABSTRACT

An alarm system for monitoring portable articles comprises a smart sensor for operatively engaging a portable article. The smart sensor includes an actuator having a secured state and an unsecured state relative to the portable article. A memory stores a sensor address. A controller has a sensor bus operatively connected to the smart sensor. The controller includes a memory storing sensor addresses. The controller is operative to periodically communicate with the smart sensor to determine state of the sensor and to read the sensor address. The controller generates an alarm when the smart sensor is in the unsecured state or if the sensor address read from the smart sensor is not stored in the memory.

18 Claims, 3 Drawing Sheets

MASTER
INITIALIZE
100
ARM, DISARM
D
102
A
SEARCH FOR SENSORS
104
108
MATCH
N
ERROR
106
Y
OBTAIN SLAVE ADDRESS
110
WAIT
112
CHECK BUS STATUS
114
116
ALARM
Y
N
118
SIGNAL ALARM
CLEARED
Y
N
120
122
DISARM

ALARM SYSTEM WITH SMART SENSORS

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

The present invention relates to security alarm systems and, more particularly, to use of a smart sensor.

BACKGROUND

Retail and wholesale merchandisers direct substantial attention to the nagging and costly problem associated with the theft and/or damage of costly display products on their premises. With the predominance of smaller and portable electronic apparatus, the ease with which pilferers and shoplifters can quickly and easily remove such goods from display cases and display racks has intensified. At the same time, the availability of such products has skyrocketed, resulting in more and more valuable products being taken or tampered with. As locks and other security devices have become more sophisticated, so too have the individuals and methods for circumventing the operation of conventional security devices and, particularly, alarm sensing devices. The alarm system described in U.S. Pat. No. 5,172,098, to Leyden, has solved many of these problems.

Security systems for portable consumer articles continue to evolve, as do both the products that they are designed to protect and the sophistication of the individuals that abscond with such articles.

The simplest security systems generally involve mechanical tethers. Commonly, a metal-cored cable with a soft coating is connected between a support and an article. The range of movement of the article relative to the support is dictated by the length of the tether. Tethers are attached to the articles using a variety of different techniques, amongst which are attachments through the use of lassos, adhesives, fasteners, etc. These mechanical systems, depending upon the nature of the cable, offer a reasonable deterrent to unsophisticated thieves. However, they are inherently prone to defeat by severance or by disconnection at the support and/or article.

The above shortcomings with mechanical systems are addressed by incorporating electronic components that can sense a security breach and alert those in the display facility, as by the use of a detectable signal generator, such as an audible alarm and/or a light, etc.

The electromechanical systems that have been developed have been widely accepted in the consumer products industry. However, those designing these electromechanical systems face a number of challenges presented by both would-be thieves and the system operators.

The recent proliferation of small, expensive, consumer articles, particularly in the electronics area, has caused a corresponding increase in theft. Consequently, there has grown a need to monitor these portable consumer articles in very different environments, including, but not limited to, those that are commercial, residential and institutional in nature.

Current alarm sensing systems for consumer articles or the like employ a simple sensor including a switch that closes when the sensor is attached to the article being monitored. Intelligent thieves have found ways to bypass such sensors which can result in continued theft of the high tech products that are being monitored. This drives up cost for consumers.

Additionally, there are issues with respect to wire management. Current systems require a cable from each sensor to the alarm monitoring station. This can result in cables interfering with one another.

The present invention is directed to improvements in alarm systems.

SUMMARY

As described herein, an exemplary alarm system comprises a master controller which controls functions of slave controllers in the system. The slave controllers control the functions of smart sensors. Each smart sensor includes an address used by the slave controller to verify that the correct sensor is connected thereto.

There is disclosed in accordance with one aspect of the invention an alarm system for monitoring portable articles comprising a smart sensor for operatively engaging a portable article. The smart sensor includes an actuator having a secured state and an unsecured state relative to the portable article. A memory stores a sensor address. A controller has a sensor bus operatively connected to the smart sensor. The controller includes a memory storing sensor addresses. The controller is operative to periodically communicate with the smart sensor to determine state of the sensor and to read the sensor address. The controller generates an alarm when the smart sensor is in the unsecured state or if the sensor address read from the smart sensor is not stored in the memory.

It is a feature that the controller comprises a programmed microcontroller.

It is another feature that the controller operates in an initialization mode comprising sending a request to the smart sensor for an address and storing a returned address in the memory.

It is a further feature to provide a standard sensor for operatively engaging a portable article. The standard sensor includes an actuator having a secured state and an unsecured state relative to the portable article. The controller may operate in an initialization mode comprising a request to the standard sensor for an address and if no address is received, then storing in memory an indication that the standard sensor does not have an address.

It is yet another feature that the controller operates in an armed mode comprising initially verifying that the smart sensor is connected and in response thereto arming the smart sensor.

It is an additional feature that the controller comprises a slave controller and further comprising a master controller operatively connected to the slave controller for commanding operation of the slave controller. The master controller may be operatively connected to the slave controller over a bus. The bus may connect the master controller to a plurality of slave controllers.

It is still another feature that the slave controller generating an alarm comprises sending a signal to the master controller that there is an active alarm.

There is disclosed in accordance with another aspect of the invention an alarm system for monitoring portable articles comprising a plurality of smart sensors each for operatively engaging a portable article. The smart sensors include an actuator having a secured state and an unsecured state relative to the portable article and a memory storing a unique sensor address. A plurality of slave controllers each has a sensor bus operatively connected to one or more of the plurality of smart sensors. The slave controllers include a memory storing sensor addresses. The slave controllers are operative to periodically communicate with the smart sensors to determine state of the sensors and to read the sensor addresses. The slave controllers generate an alarm if any smart sensor is in the unsecured state or if the sensor address read from any smart sensor is not stored in the memory. A master controller is operatively connected to the slave controllers for commanding operation of the slave controllers.

Other features and advantages will be apparent from a review of the entire specification, including the appended claims and drawings.

DETAILED DESCRIPTION

The apparatus disclosed herein uses smart sensors with an alarm system. This effectively moves some of the "intelligence" from the alarm control box to the sensors themselves. Moving some of the system intelligence to the sensor results in a system that will improve theft prevention.

Figure 1:
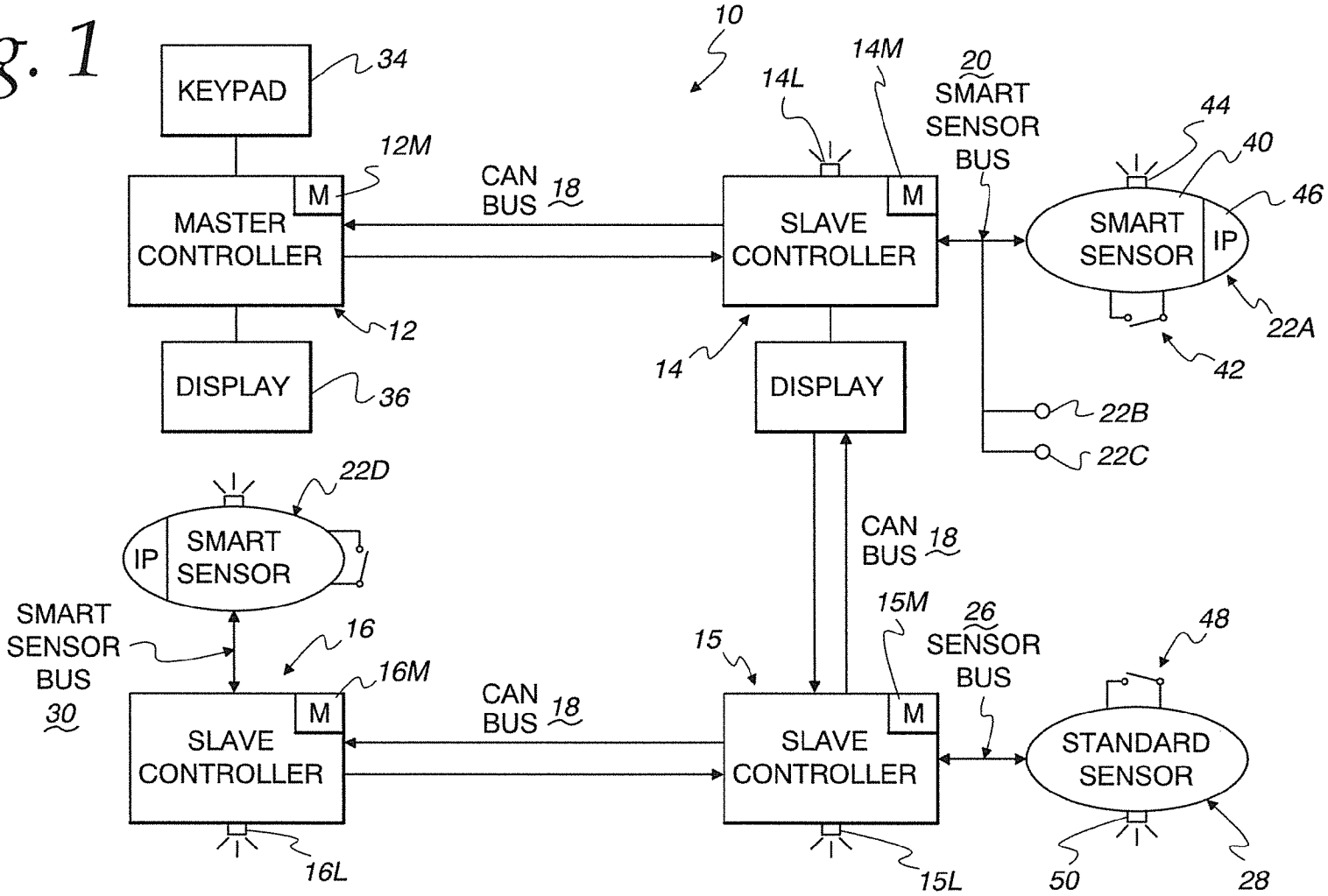
FIG. 1 is a block diagram of an alarm system with smart sensors in accordance with the invention.

Referring initially to FIG. 1, an alarm system 10 is illustrated in block diagram form. The alarm system 10 comprises a master controller 12 and a plurality of slave controllers 14, 15 and 16. While three slave controllers are illustrated the master controller 12 could be used with any number of slave controllers, as configured. Each of the slave controllers 14-16 is of identical construction. The slave controllers 14-16 are electrically connected to the master controller 12 via a controller area network (CAN) bus 18. The first slave controller 14 is connected to a smart sensor bus 20 for connecting to a plurality of smart sensors 22A, 22B and 22C. Only the first smart sensor 22A is illustrated in detail. The other smart sensors 22B and 22C are illustrated as nodes. For simplicity hereinbelow, the smart sensors will be described generically with the numeral 22. The second slave controller 15 includes a sensor bus 26 for connecting to a standard sensor 28. The third slave controller 16 includes a smart sensor bus 30 for connection to a smart sensor 22D.

The master controller 12 comprises a programmed microcontroller including a memory 12M for storing a control program and data. The master controller 12 includes an associated keypad 34 and display 36. The keypad 34 and 36 could be integral elements of a touch pad display, or the like.

The first slave controller 14 comprises a programmed microcontroller including a memory 14M for storing a control program and data for operating the first slave controller 14. The slave controller 14 includes a system LED 14L. The second slave controller 15 and the third slave controller 16 include similar components and are therefore not described in detail herein.

Each smart sensor 22 comprises a housing 40 of any known form including an actuator represented by a switch 42 which completes an electrical circuit when the sensor 22 is attached to a portable consumer article, or the like, being monitored. Particularly, in an unsecured state the switch 42 is open and in a secured state, attached to an article, the switch 42 is closed. The sensor 22 includes an integrated LED 44 to indicate alarm status. The switch 42 may take any known form such as electromechanical switch or an electronic switch, as necessary. The smart sensor 22 includes a small IC chip 46 which includes memory that stores a unique ID to identify the sensor 22. As is apparent, each sensor 22A-22D will have its own unique address.

The standard sensor 28 is a conventional sensor in that it does not include the IC chip 46. It may be of the type as illustrated in U.S. Pat. No. 5,552,771, to Leyden et al., the specification of which is hereby incorporated by reference herein. The sensor 28 includes an actuator represented by a switch 48 which, as above, completes an electrical circuit when the sensor 28 is attached to a device and includes an integrated LED 50 to indicate alarm status.

As described more particularly below, using the smart sensor technology the smart sensor 22 will periodically communicate with the slave controller 14. The smart sensor 22 cannot be cut, shorted or removed without an alarm being set off. The slave controller 14 manages information between the master controller 12 and the smart sensor 22. If the slave controller 14 receives the correct ID from the smart sensor 22, then the slave controller 14 will notify the master controller 12 that the smart sensor 22 is present and the master controller 12 will remain in an armed mode. Conversely, if the slave controller 14 does not receive a correct ID from the smart sensor 22, then the slave controller 14 will send a signal to the master controller 12 indicating that the smart sensor 22 has been compromised and an alarm will sound. The master controller 12 will then send a signal back to the slave controller 14 telling the slave controller 14 that the alarm has been registered.

All of the communications between the master controller 12 and slave controllers 14-16 is over the four wire CAN bus 18. The CAN bus 18 used in the exemplary embodiment of the invention was developed by Robert Bosch GmbH for use in automobiles. As is apparent, other types of communication and data buses could be used.

The smart sensor busses 20, 26 and 30 comprise six wire buses which provide signals from the smart sensors 22 to the particular slave controller to indicate sensor ID and sensor status. The sensor LEDs are controlled from the respective slave controllers.

The master controller 12 provides complete system control. The master controller 12 may be battery operated with AC backup. It may include various LEDs for programming and indication, as necessary or desired.

Figure 2:
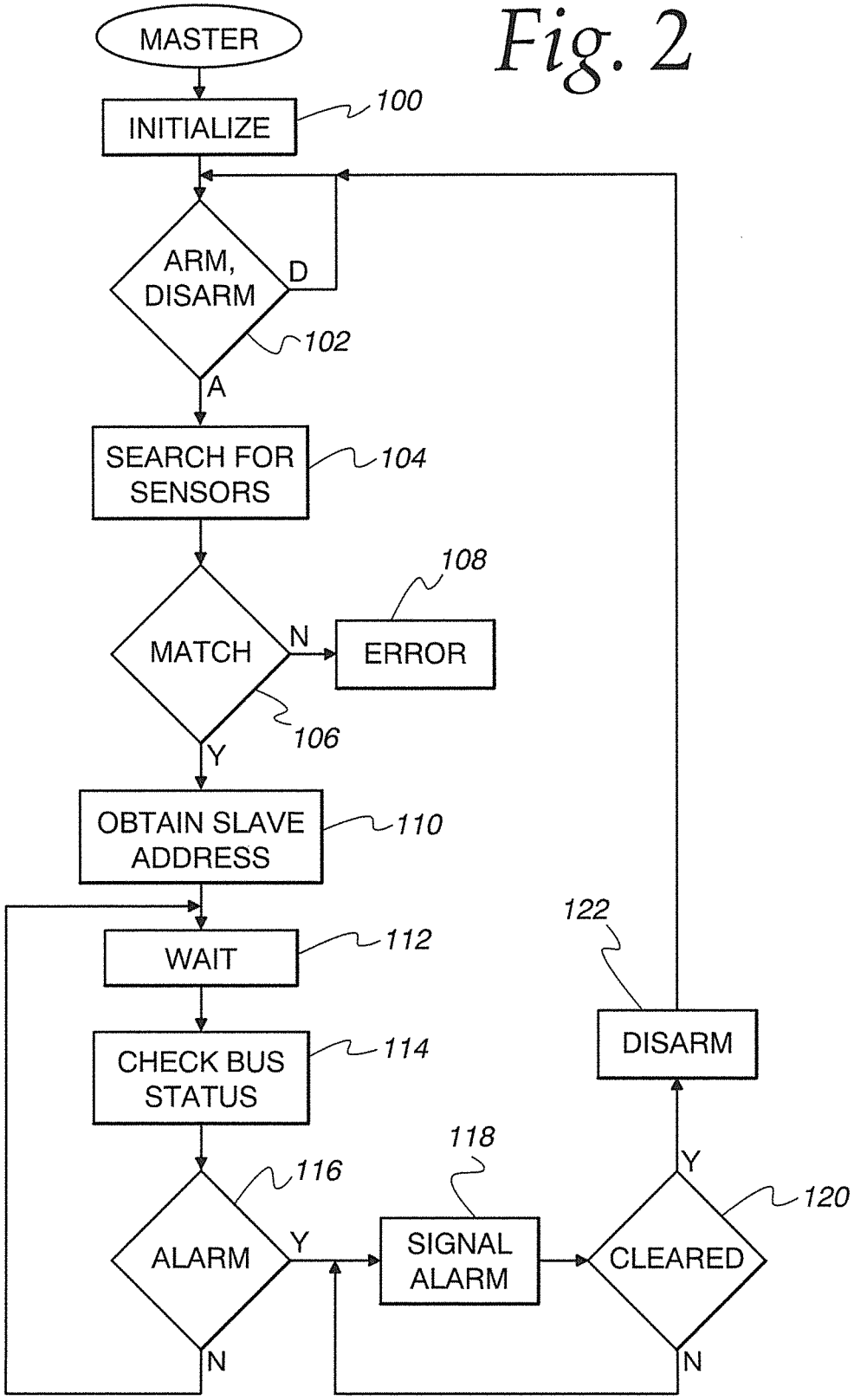
FIG. 2 is a flow diagram of a program implemented by the master controller of FIG. 1.

FIG. 2 illustrates a flow diagram for a program implemented by the master controller 12 for use with smart sensor technology. As will be apparent, the master controller 12 may implement other features unrelated to the smart sensor technology and which are not described herein.

The flow diagram begins at a block 100 which performs an initialization routine to load in default parameters and stored parameters and then enter a standby mode. The master controller also uses a programming mode, not illustrated, wherein the user by entering an access code can indicate the number of sensors in the system 10.

In the standby mode the system 10 is also in a disarm mode. In the disarm mode the master controller 12 will not monitor alarm conditions. A decision block 102 determines if the master controller 12 is in the arm or disarm mode. To enter the arm mode, the user must press an arm/disarm button and enter the access code. The program will then search for sensors at a block 104. This is done by communicating with the slave controllers 14-16. A decision block 106 determines if the number of sensors found matches the number of sensors entered in the programming function, discussed above. If not, then the program enters an error routine at a block 108. The master controller sends a query on the bus 18 to the slave controllers 14-16 to obtain slave controller addresses at a block 110. The master controller 12 arms the system if there is a sensor 22 connected with each slave controller 14-16. If there is an open slave controller having no sensor, then the system will advance to the system error mode. In the armed state for the alarm system 10, a change in state of the sensors 22 or 28 from the secured state into the unsecured state will be detected by the slave controllers 14-16, and thus the master controller 12, which thereby causes a detectable signal, such as an alarm horn or visual indication, to be activated to alert an individual in the vicinity of the alarm system 10 that there has been a security breach.

Once the system 10 is armed, then the master controller 12 will go into a sleep mode if being operated on battery power. If external power is applied, the master controller 12 will not go to sleep.

The master controller will wait at a block 112 for thirty seconds. Every thirty seconds the master controller 12 will wake up, if in a sleep mode, and also check the bus status at a block 114. A decision block 116 will determine if any alarm signal has been returned from the slave controllers 14-16. If not, then the program returns to the block 112 to wait for an additional thirty seconds. As is apparent, a different delay time could be used. If an alarm is detected, then the master controller 12 signals an alarm at a block 118 such as displaying that there is an alarm in progress and sounding a horn. An alarm condition is also found if the master controller 12 cannot communicate with one of the slave controllers 14-16. A decision block 120 then determines if the alarm has been cleared. If not, the controller moves back to the block 118. If so, then the system 10 is disarmed at a block 122 so that the user can correct the issue. The program then loops back to the decision block 102, discussed above.

Figure 3:
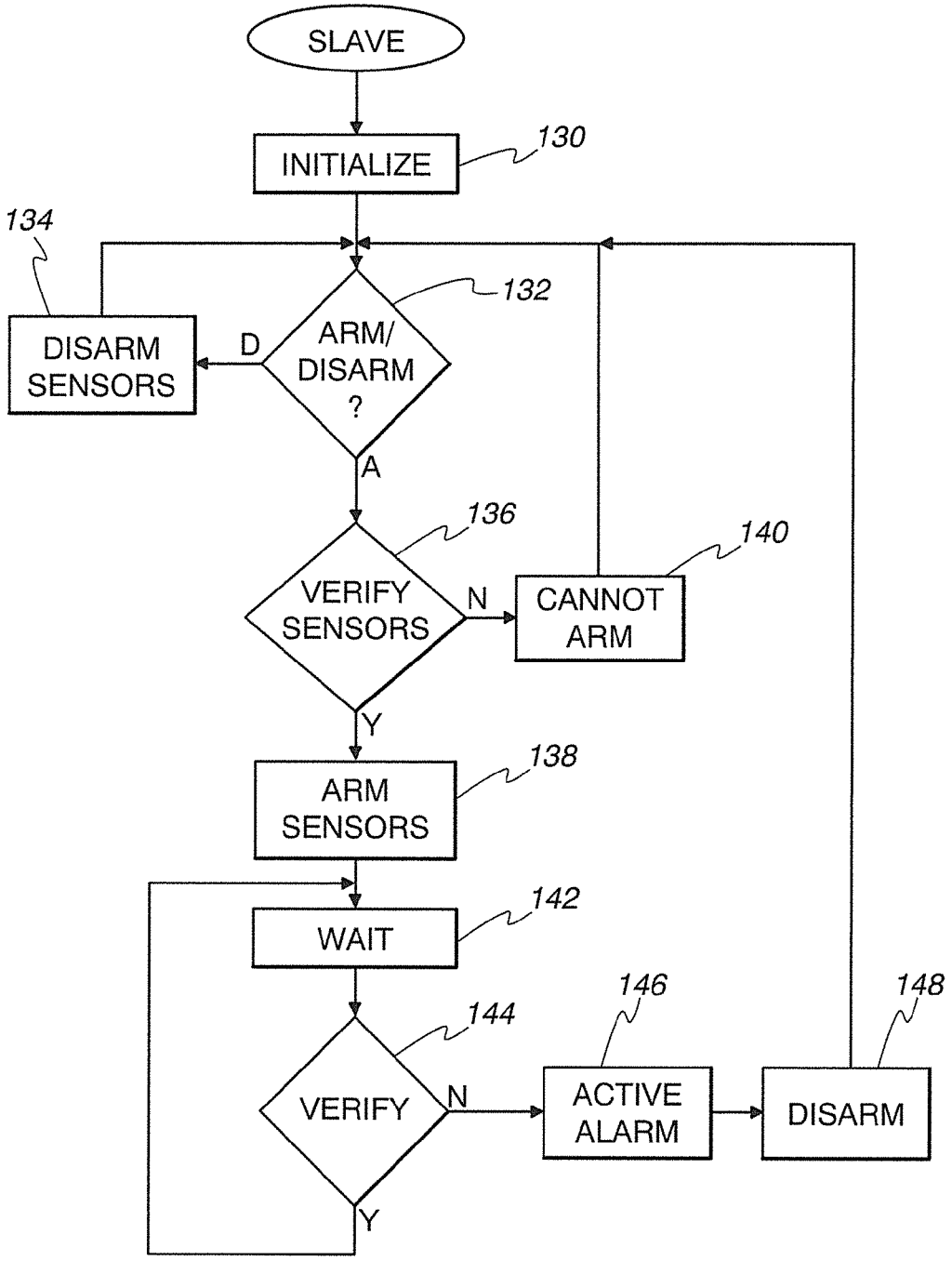
FIG. 3 is a flow diagram of a program implemented by the slave controllers of FIG. 1.

As discussed above, the slave controllers 14-16 can be used with a smart sensor 22 or a standard sensor 28. FIG. 3 illustrates a flow diagram for a program implemented in each of the slave controllers 14-16. The following discussion relates to the slave controller 14, it being understood that the other slave controllers 15 and 16 operate similarly.

The program begins at an initialize block 130. The slave controller 14 flashes the LED 14L once every fifteen seconds. The slave controller 14 alternately flash red and green sensor LEDs 44 once every fifteen seconds for a smart sensor 22 or alternately flashes a green sensor LED 50 every fifteen seconds for a standard sensor 28. The slave controller 14 sends a request to the smart sensors 22 over the bus 20. If the sensor responds with an address, then the slave controller 14 records the address for the smart sensor 22 in the memory 14M. If the sensor responds with no address but has an active low signal, then the slave controller 14 records presence of a standard sensor 28. If the sensor responds with no address but is an active high signal, then the slave controller 14 records that there is no sensor present. This process is repeated for all sensors on the sensor bus 20.

Once the initialization routine is completed, then the slave controller 14 waits at a decision block 132 for a command from the master controller to arm and/or disarm. If there is a command to disarm, then the sensors 22 and 28 are disarmed at a block 134. If the master controller 12 issues an arm command, then the slave controller verifies that each sensor is connected and functional at a decision block 136. This verification includes comparing the returned sensor address to the address stored in memory 14M, and verifying that the switch 42 is actuated, thus being in a secured state. If each sensor is present, then the slave controller 14 verifies that sensor and arms that sensor at a block 138. If a sensor cannot be armed, either because the returned address is incorrect or the sensor is in an unsecured state, then the slave controller 14 sends a message back to the master controller 12 that a sensor is in an unsecured state and will not arm at a block 140. The slave controller 14 will flash the system LED 14L once every thirty seconds and flash a red sensor LED 44 or 50 once every thirty seconds. The slave controller 14 then goes into a sleep mode at a block 142 and wake up every thirty seconds to verify that the sensors are still active.

When the slave controller 14 wakes up, then a decision block 144 attempts to verify each sensor, as discussed above. If all of the sensors are verified, then the program loops back to the block 142. When an alarm is detected by the slave controller 14, determined by a change in state on the smart sensor bus 20, or an incorrect address, then the slave controller 14 notifies the master controller 12 that there is an active alarm at a block 146 and also flashes the red sensor LED 44 and the system LED 14L. The slave controller 14 then waits until the master controller 12 commands the slave controller to disarm at a block 148 and the program then loops back to the block 132, discussed above.

In the illustrated embodiment, there are three slave controllers 14-16. However, the master controller 12 is configured to operate with as many thirty slave controllers. Each slave controller 14-16 can connect to a plurality of sensors, the number dependent on the programming and memory requirements.

The present invention has been described with respect to flowcharts and block diagrams. It will be understood that each block of the flowchart and block diagrams can be implemented by computer program instructions. These program instructions may be provided to a processor to produce a machine, such that the instructions which execute on the processor create means for implementing the functions specified in the blocks. The computer program instructions may be executed by a processor to cause a series of operational steps to be performed by the processor to produce a computer implemented process such that the instructions which execute on the processor provide steps for implementing the functions specified in the blocks. Accordingly, the illustrations support combinations of means for performing a specified function and combinations of steps for performing the specified functions. It will also be understood that each block and combination of blocks can be implemented by special purpose hardware-based systems which perform the specified functions or steps, or combinations of special purpose hardware and computer instructions.

It will be appreciated by those skilled in the art that there are many possible modifications to be made to the specific forms of the features and components of the disclosed embodiments while keeping within the spirit of the concepts disclosed herein. Accordingly, no limitations to the specific forms of the embodiments disclosed herein should be read into the claims unless expressly recited in the claims. Although a few embodiments have been described in detail above, other modifications are possible. For example, the logic flows depicted in the figures do not require the particular order shown, or sequential order, to achieve desirable results. Other steps may be provided, or steps may be eliminated, from the described flows, and other components may be added to, or removed from, the described systems. Other embodiments may be within the scope of the following claims.

The invention claimed is:

1. An alarm system for monitoring portable articles comprising:

a smart sensor for operatively engaging a portable article, the smart sensor including an actuator having a secured state and an unsecured state relative to the portable article, and a memory storing a sensor address;

a controller having a sensor bus operatively connected to the smart sensor, the controller including a memory storing sensor addresses, and the controller being operative to periodically communicate with the smart sensor to determine state of the sensor and to read the sensor address, the controller generating an alarm if the smart sensor is in the unsecured state or if the sensor address read from the smart sensor is not stored in the memory.

2. The alarm system of claim 1 wherein the controller comprises a programmed microcontroller.

3. The alarm system of claim 1 wherein the controller operates in an initialization mode comprising sending a request to the smart sensor for an address and storing a returned address in the memory.

4. The alarm system of claim 1 further comprising a standard sensor for operatively engaging a portable article, the standard sensor including an actuator having a secured state and an unsecured state relative to the portable article.

5. The alarm system of claim 4 wherein the controller operates in an initialization mode comprising sending a request to the standard sensor for an address and if no address is received then storing in memory an indication that the standard sensor does not have an address.

6. The alarm system of claim 1 wherein the controller operates in an armed mode comprising initially verifying that the smart sensor is connected and in response thereto arming said smart sensor.

7. The alarm system of claim 1 wherein the controller comprises a slave controller and further comprising a master controller operatively connected to the slave controller for commanding operation of the slave controller.

8. The alarm system of claim 7 wherein the master controller is operatively connected to the slave controller over a bus.

9. The alarm system of claim 8 wherein the bus connects the master controller to a plurality of slave controllers.

10. The alarm system of claim 7 wherein the slave controller generating an alarm comprises sending a signal to the master controller that there is an active alarm.

11. The alarm system of claim 7 wherein the slave controllers generating an alarm comprises sending a signal to the master controller that there is an active alarm.

12. An alarm system for monitoring portable articles comprising:

a plurality of smart sensors each for operatively engaging a portable article, each of the smart sensors including an actuator having a secured state and an unsecured state relative to the portable article, and a memory storing a unique sensor address;

a plurality of slave controllers each having a sensor bus operatively connected to one or more of the plurality of smart sensors, the slave controllers including a memory storing sensor addresses, and the slave controllers being operative to periodically communicate with the smart sensors to determine state of the sensors and to read the sensor addresses, the slave controllers generating an alarm if any smart sensor is in the unsecured state or if the sensor address read from any smart sensor is not stored in the memory; and a master controller operatively connected to the slave controllers for commanding operation of the slave controllers.

13. The alarm system of claim 12 wherein the master controller and the slave controllers comprise programmed microcontrollers.

14. The alarm system of claim 12 wherein the master controller operates in an initialization mode comprising sending a request to the slave controllers for a number of sensors connected to each slave controller.

15. The alarm system of claim 14 wherein the master controller operates in an armed mode comprising initially verifying that the number of sensors connected to each slave controller matches the number stored in memory and in response thereto arming said slave controllers.

16. The alarm system of claim 12 further comprising a standard sensor for operatively engaging a portable article, the standard sensor including an actuator having a secured state and an unsecured state relative to the portable article.

17. The alarm system of claim 16 wherein the slave controllers operate in an initialization mode comprising sending a request to the sensors for an address and if storing a returned address in the memory or no address is received then storing in memory an indication that the sensor does comprises a standard sensor.

18. The alarm system of claim 12 wherein the master controller is operatively connected to the slave controllers over a bus.

* * * * *